US009368008B2

(12) United States Patent
Jefferies et al.

(10) Patent No.: US 9,368,008 B2
(45) Date of Patent: Jun. 14, 2016

(54) ELECTRIC VEHICLE SUPPLY EQUIPMENT CABLE DETECTION

(75) Inventors: Kevin M. Jefferies, Raleigh, NC (US); Benjamin W. Edwards, Rolesville, NC (US); Matthew L. White, Raleigh, NC (US); Konstantin Alexander Filippenko, Raleigh, NC (US)

(73) Assignee: Schneider Electric USA, Inc., Palatine, IL (US)

( * ) Notice: Subject to any disclaimer, the term of this patent is extended or adjusted under 35 U.S.C. 154(b) by 542 days.

(21) Appl. No.: 13/483,433

(22) Filed: May 30, 2012

(65) Prior Publication Data

US 2013/0320920 A1 Dec. 5, 2013

(51) Int. Cl.
*G08B 13/14* (2006.01)

(52) U.S. Cl.
CPC ..... *G08B 13/1418* (2013.01)

(58) Field of Classification Search
CPC . Y02T 90/14; Y02T 10/7005; G08B 13/1418
USPC ..... 320/109, 104, 107
See application file for complete search history.

(56) References Cited

U.S. PATENT DOCUMENTS

| | | | | |
|---|---|---|---|---|
| 4,571,691 | A | 2/1986 | Kennon | |
| 5,293,115 | A | 3/1994 | Swanson | |
| 5,714,942 | A | 2/1998 | Buchanan | |
| 6,150,940 | A * | 11/2000 | Chapman et al. | 340/568.3 |
| 6,700,501 | B2 | 3/2004 | Winton | |
| 2010/0007306 | A1 * | 1/2010 | Fukui et al. | 320/107 |
| 2010/0238020 | A1 * | 9/2010 | Pellen | 340/533 |
| 2010/0271192 | A1 | 10/2010 | Mituta | |
| 2012/0007553 | A1 * | 1/2012 | Ichikawa et al. | 320/109 |
| 2012/0022811 | A1 * | 1/2012 | Dickinson et al. | 702/60 |
| 2012/0091958 | A1 * | 4/2012 | Ichikawa et al. | 320/109 |
| 2012/0119702 | A1 * | 5/2012 | Gaul et al. | 320/109 |

FOREIGN PATENT DOCUMENTS

| | | | |
|---|---|---|---|
| CN | 201196674 | Y | 2/2009 |
| CN | 101803142 | A | 8/2010 |
| CN | 202159397 | U | 3/2012 |
| CN | 102414044 | A | 4/2012 |
| DE | 102007052653 | A1 | 5/2009 |
| DE | 202010014540 | U1 | 4/2011 |
| GB | 2208953 | A | 4/1989 |

OTHER PUBLICATIONS

International Search Report and Written Opinion for PCT/US2013/042875, dated Aug. 23, 2013.
Nov. 11, 2015—(CN) Office Action—App 201380028361.0.

* cited by examiner

*Primary Examiner* — Samuel Berhanu
*Assistant Examiner* — Tessema Kebede
(74) *Attorney, Agent, or Firm* — Banner & Witcoff, Ltd.

(57) ABSTRACT

Systems, methods, devices, and computer-readable media detect a status of a cable 204, and in particular, a cable of electric supply equipment. An example of electric supply equipment is electric vehicle supply equipment 200, which may be used for charging an electric vehicle 201. The electric vehicle supply equipment 200 may include a cable 204 for delivering electric power from a power source to the electric vehicle 201. Further, the electric vehicle supply equipment 200 may include a cable detection subcircuit 225 for detecting a status of its cable 204. Specifically, the cable detection subcircuit 225 may detect whether the cable 204 has been removed. Further, the electric vehicle supply equipment 200 may take various actions based on results provided by the cable detection subcircuit 225.

22 Claims, 6 Drawing Sheets

ELECTRIC VEHICLE SUPPLY EQUIPMENT CABLE DETECTION

FIELD OF ART

Aspects of the disclosure generally relate to detecting a status of a cable for electric vehicle supply equipment, and in particular, detecting theft of a cable from electric vehicle supply equipment.

BACKGROUND

Demand for electric supply equipment is growing as the desire to reduce the global dependency on fossil fuels increases. As technology related to electric motors advances, more and more electric motors replace combustion engines. This effect has already begun in the automotive industry. Today, hybrid and electric vehicles are becoming increasingly popular. Accordingly, demand for supplying these vehicles with electric power is rising.

To meet this demand, individuals and corporations have been increasing production and installation of electrical vehicle supply equipment (EVSE), also referred to as charging stations. Among other components, this equipment typically includes a cable (also referred to as a cord set) for delivering an electric supply from a power supply source to the electric vehicle. To perform this function, the cable is commonly built using large cross section copper conductors because copper conductors are usually satisfactory for delivering the power required to charge electric vehicles.

For user convenience, these cables may be multiple feet, or even meters, in length so as to extend from the EVSE to an electric vehicle. That is, the cable may be designed so that it is long enough to reach a user's vehicle so that the user can charge his/her vehicle. Accordingly, the cable may contain a significant amount of valuable conductive material, such as copper. Thus, the cable of the EVSE may be subject to theft.

Further, EVSEs may be particularly vulnerable to theft because they may be installed in numerous locations. That is, the EVSEs may be spread out over a large area, instead of being grouped together. Therefore, it may be especially difficult for an owner or operator to monitor multiple EVSEs.

Accordingly, new systems and methodologies are required to protect against cable theft and improve the user friendliness, safety, and cost of ownership of electric supply equipment, such as electric vehicle supply equipment.

BRIEF SUMMARY

In light of the foregoing background, the following presents a simplified summary of the present disclosure in order to provide a basic understanding of some aspects of the invention. This summary is not an extensive overview of the invention. It is not intended to identify key or critical elements of the invention or to delineate the scope of the invention. The following summary merely presents some concepts of the invention in a simplified form as a prelude to the more detailed description provided below.

In the current art, EVSE cable theft is difficult to detect because pins on the EVSE connector (e.g., the connector specified by "SAE Recommended Practice J1772, SAE Electric Vehicle and Plug in Hybrid Electric Vehicle Conductive Charge Coupler" (hereinafter referred to as SAE J1772) including pins for power lines L1 and L2/N, a ground line, and a control pilot line) at the end of the EVSE's cable are all open unless connected to an electric vehicle. In other words, EVSE cable theft detection is impractical because no closed circuit, including the cable, is formed when the cable is not connected to an electric vehicle. Accordingly, this disclosure provides the benefit of cable theft detection by the EVSE without requiring custom hardware at the connector. For example, the present disclosure provides a manner for detecting cable theft using the EVSE connector specified by SAE J1772 by extending the proximity line to a cable detection subcircuit included within the EVSE control box. Further, this disclosure provides EVSE cable theft detection solutions with minimal hardware requirements and costs.

Aspects of the disclosure address one or more of the issues mentioned above by disclosing methods, computer readable media, and apparatuses for providing improved electric supply equipment. Further, aspects of the disclosure provide electric supply equipment that may detect the status of its own cable. For example, the electric supply equipment may detect whether a cable remains connected to the electric supply equipment or whether the cable has been removed. It is anticipated that some people may cut, pull-out, or otherwise remove the cable from electric supply equipment. Thus, the electric supply equipment disclosed herein may detect whether the cable has been stolen, and therefore, the electric supply equipment of the present disclosure may prevent or deter theft.

In some aspects of the disclosure, if the cable has been removed, the electric supply equipment may detect a time at which it was removed. Additionally, the electric supply equipment may trigger a response to detecting that the cable has been removed. Various responses are disclosed herein.

Furthermore, in some aspects of the disclosure, the electric supply equipment may be electric vehicle supply equipment for supplying electric power to an electric vehicle. The electric vehicle supply equipment may prevent or deter theft of the cable used for supplying the electric power to an electric vehicle. Accordingly, the electric vehicle supply equipment of the present disclosure may offer an alternative to manual means for protecting against cable theft and/or other costly means for protecting against cable theft.

The present disclosure teaches a cable detection subcircuit that may be implemented in electric supply equipment, such as electric vehicle supply equipment. The cable detection subcircuit may automatically detect the status of a cable. The cable detection subcircuit may detect the status by injecting a current onto a conductor that extends into the cable and determining if a closed circuit loop exists. If the closed circuit loop exists, then the cable detection subcircuit may output a signal indicating that the cable remains intact. In contrast, if the closed loop does not exist, then the cable detection subcircuit may output a signal indicating that the cable has been removed.

Of course, the methods and systems of the above-referenced embodiments may also include other additional elements, steps, computer-executable instructions or computer-readable data structures. In this regard, other embodiments are disclosed and claimed herein as well. The details of these and other embodiments of the present disclosure are set forth in the accompanying drawings and the description below. Other features and advantages of the invention will be apparent from the description and drawings and from the claims.

BRIEF DESCRIPTION OF THE DRAWINGS

The present disclosure is illustrated by way of example and is not limited in the accompanying figures in which like reference numerals indicate similar elements and in which.

DETAILED DESCRIPTION

In accordance with various aspects of the disclosure, methods, computer-readable media, and apparatuses are disclosed to detect the status of a cable of electric supply equipment. Herein, the status of the cable may refer to the condition of the cable and may indicate whether it remains intact, has been removed, is damaged, etc. Further, where the cable is described as being removed, removal may include removal by any manner, such as cutting, pulling-out, detaching, etc. Also, in some cases, a cable may be considered to have been removed if any part of it has been removed. That is, a cable may be described as having been removed, if a portion of it has been cut off.

This disclosure provides a non-exhaustive description of various embodiments of the electric supply equipment and its cable detection subcircuit. Herein, example embodiments of the electric supply equipment relate to electric vehicle supply equipment. However, it should be understood that aspects of the disclosure are applicable to other types of electric supply equipment, particularly equipment including a cable made with valuable copper conductors, as in the case of electric vehicle supply equipment.

Figure 1:
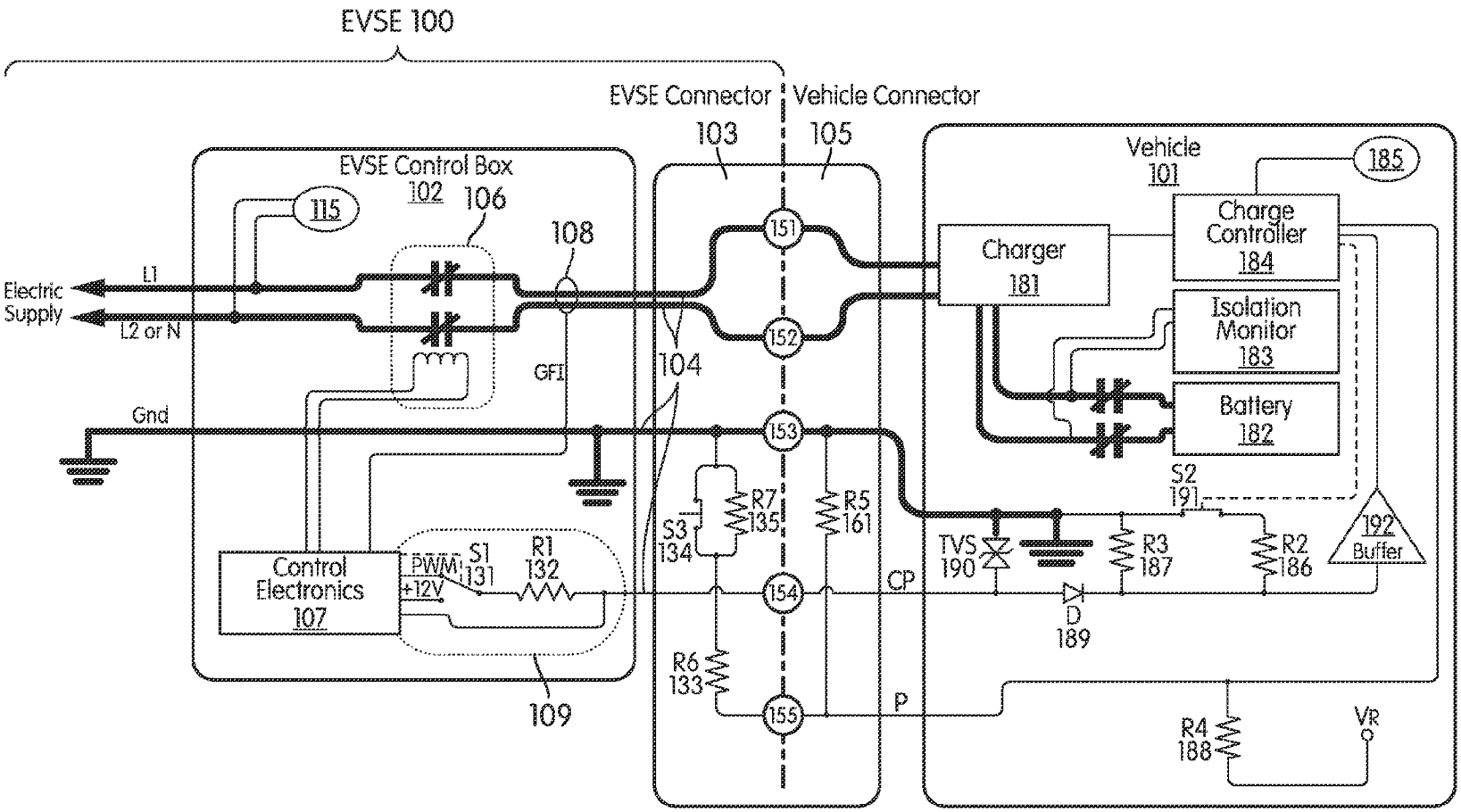
FIG. 1 is a diagram illustrating an example configuration of electric vehicle supply equipment according to an aspect of the present disclosure.

FIG. 1 is a diagram illustrating an example configuration of an electric supply device according to an aspect of the present disclosure. More specifically, FIG. 1 illustrates an example configuration of electric vehicle supply equipment (EVSE) 100, which is one type of electric supply device. It should be understood that FIG. 1 does not show all components of the EVSE 100, and instead focuses on some basic components of the EVSE 100, as specified in SAE J1772. Further, FIG. 1 shows the EVSE 100 in a state in which it is connected to and charging an electric vehicle 101. Therefore, in addition to showing some basic components of the EVSE 100, FIG. 1 also shows some of the basic components of the electric vehicle 101.

As shown in FIG. 1, the EVSE 100 includes an EVSE control box 102, an EVSE connector (i.e., plug) 103, and a cable 104 that connects the EVSE control box 102 to the EVSE connector 103. The cable 104 may be fixedly or removably connected to the EVSE control box 102 and/or the EVSE connector 103. From a safety or regulatory standpoint, it may be desirable to fixedly connect the cable 104 to the EVSE control box 102 and EVSE connector 103. In contrast, for various reasons (e.g., more economical, easier to fix, etc.), it may be desirable to easily remove the cable 104 from the EVSE control box 102 and/or connector 103. For example, if it is determined that the cable 104 is defective (e.g., insulation is damaged, discontinuity exists in conductors, etc.), the cable 104 may be removed and replaced with a new cable. Thus, the cable 104 may be replaced without replacing the entire EVSE 100. Meanwhile, the EVSE connector 103 is configured to be removably connected to a vehicle connector 105 (e.g., a vehicle inlet) of one or more electric vehicles 101. That is, the EVSE connector 103 should comply with relevant standards so that it may connect with a plurality of electric vehicles 101. One non-limiting example standard is SAE J1772.

In the current art, theft of the cable 104 is difficult to detect because pins on the EVSE connector 103 (which complies with SAE J1772) are all open unless connected to the electric vehicle 101. In other words, theft detection of the cable 104 of the EVSE 100 may be impractical when no closed circuit, including the cable 104, is formed. Accordingly, this disclosure provides the benefit of cable theft detection by the EVSE 100 without requiring custom hardware at the EVSE connector 103. For example, the present disclosure provides a manner for detecting theft of the cable 104 using the EVSE connector 103 by extending a proximity line P to a cable detection subcircuit (described in further detail below) included within the EVSE control box 102. Further, this disclosure provides solutions for detecting theft of the cable 104 that may minimize hardware requirements and costs. Notably, this disclosure contemplates that standards may change and/or new standards may be adopted, and thus, aspects of the disclosure may be adapted accordingly.

As mentioned above, FIG. 1 illustrates an embodiment in which an electric power source drives current from the EVSE 100 through the cable 104 to the electric vehicle 101. The electric power source may supply alternating current (AC) power and/or direct current (DC) power. Also, the electric power source may be configured to supply various levels of electric power. For example, the electric power source may provide 120 VAC and/or 240 VAC. Moreover, in a case in which AC power is supplied, the frequency of the alternating current may vary (e.g., 60 Hz, 50 Hz). The cable 104 may include a plurality of conductor lines for delivering the electric power supply. As shown in FIG. 1, the cable 104 may include a first power line L1 and a second power line L2/N for carrying current and supplying electric power. In some embodiments, which are not illustrated but would be understood by one of ordinary skill in the art in light of the present disclosure, the cable 104 may include additional AC power conductor lines to provide multi-phase power (e.g., three-phase power). Additionally, the cable 104 may include a ground line Gnd that couples the equipment ground terminal of the EVSE 100 to the chassis ground of the electric vehicle 101 during charging. Each of the conductor lines (i.e., the first power line L1, the second power line L2/N, and the ground line Gnd) may include copper, aluminum, or other conductive materials wrapped with an insulator. The three lines may be wrapped together by a second insulator. Thus, from the user's perspective, the cable 104 may appear to be a single wire. In some embodiments, the cable 104 may also include additional conductors, such as a control pilot line CP (discussed in further detail below), DC power lines (not shown), etc.

The EVSE control box 102 refers to a main structure that houses one or more components of the EVSE 100. Although shown as a single structure, the EVSE control box 102 may be the compilation of multiple separate structures. The EVSE control box 102 may include an electric supply indicator 115.

Further, the EVSE control box 102 may include a contactor 106 for de-energizing the EVSE 100. The contactor 106 functions like a switch (or relay) to open and close a path through the first and second power lines L1 and L2 for current to pass. As shown in FIG. 1, the contactor 106 is located between the electric power source and the cable 104, and therefore, acts to connect or disconnect the electric power source to the cable 104. When the contactor 106 is in a closed state, current is able to pass from the electric power source through the first and second power lines L1 and L2 to the cable 104. In contrast, when the contactor 106 is in an open state, current cannot pass from the electric power source to the cable 104. Moreover, the contactor 106 is especially suited for de-energizing the first and second power lines L1 and L2 so that electric charge on the cable can be quickly and safely dissipated.

The EVSE control box 102 may also include control electronics 107 for controlling the contactor 106. More specifically, the control electronics 107 control whether the contactor 106 is in the open state or closed state, and therefore, control when to de-energize the first and second power lines L1 and L2. The control electronics 107 may comprise various circuit components, such as resistors, capacitors, inductors, etc., and/or be implemented with one or more integrated circuits. In some embodiments, the control electronics 107 may be implemented on a printed circuit board (PCB).

In addition, the EVSE control box 102 may include a ground fault interrupter (GFI) 108 for detecting differential current between the first power line L1 and the second power line L2/N. When the differential current exceeds a threshold, the GFI may transmit a signal to the control electronics 107, which in response may switch the contactor 106 to the open state.

Further, the control electronics 107 may also interface with a monitoring circuit 109. The monitoring circuit 109 may be coupled to the control pilot line CP through which it may generate a control pilot signal. In one or more arrangements, such as that shown in FIG. 1, the monitoring circuit 109 may include a switch (S1) 131 and resistor (R1) 132, and a pulse width modulation (PWM) signal generator or other oscillator (not shown) for generating an oscillating signal (e.g., a PWM signal). The monitoring circuit 109 may monitor a voltage on the control pilot line CP. Based on the detected voltages, the monitoring circuit 109 and control electronics 107 may determine a state of the electric vehicle 101. For example, the monitoring circuit 109 and control electronics 107 may determine whether the electric vehicle 101 is connected to the EVSE 100 or not and/or whether the electric vehicle 101 is ready to be charged. Although the monitoring circuit 109 is shown separately, it may be incorporated into the control electronics 107.

Still referring to FIG. 1, the EVSE connector 103 may include five contact points 151-155 configured to electrically couple the EVSE connector 103 to the vehicle connector 105 (e.g., a vehicle inlet) of the electric vehicle 101. The contact points 151-155 may provide a connection to the first power line L1, the second power line L2/N, the ground line Gnd, the control pilot line CP, and a proximity circuit, respectively. In some embodiments, one or more of the five contact points 151-155 may include prongs (which may protrude from a base structure of the EVSE connector 103) that are configured to be inserted into the vehicle connector 105 of the electric vehicle 101. The vehicle connector 105 may include a resistor (R5) 161 coupled between the ground line Gnd and the contact point 155.

Further, the EVSE connector 103 may include the proximity circuit. The proximity circuit may be used to detect the presence of the EVSE connector 103 at the vehicle connector 105. Specifically, the electric vehicle 101 may detect that the EVSE connector 103 is connected to the vehicle connector 105 by applying a signal to the proximity line P and detecting an impedance of the proximity circuit. Thus, in response to receiving a signal from the proximity circuit, the electric vehicle 101 may prepare for charging. Numerous configurations may be implemented to provide the proximity circuit. As shown in FIG. 1, the proximity circuit may include a resistor (R6) 133 coupled in series with both a switch (S3) 134 and a resistor (R7) 135, which are in parallel with one another. One end of the resistor (R6) 133 may be coupled to the proximity circuit contact 155. Meanwhile, an end of the switch (S3) 134 and resistor (R7) 135, which are in parallel, is coupled to the ground line Gnd. The switch (S3) 134 may be actuated manually (e.g., by a user pressing a button) or mechanically (e.g., by a latch that slides when a user connects the EVSE connector 103 to the vehicle connector 105). In one or more arrangements, the switch (S3) 134 may be configured to only close when the EVSE connector 103 is connected to a specific connector (e.g., the vehicle connector 105).

Turning to the electric vehicle 101, although the electric vehicle 101 may include many parts, FIG. 1 shows only some parts that are related to charging the electric vehicle 101. Specifically, FIG. 1 shows that the electric vehicle 101 may include a charger 181, a battery 182, an isolation monitor 183, a charge controller 184, a charge status indicator 185, and circuit components, such as resistors (R2-R4) 186-188, a diode (D) 189, a transient-voltage-suppression diode (TVS) 190, a switch (S2) 191, and a buffer 192.

Figure 2:
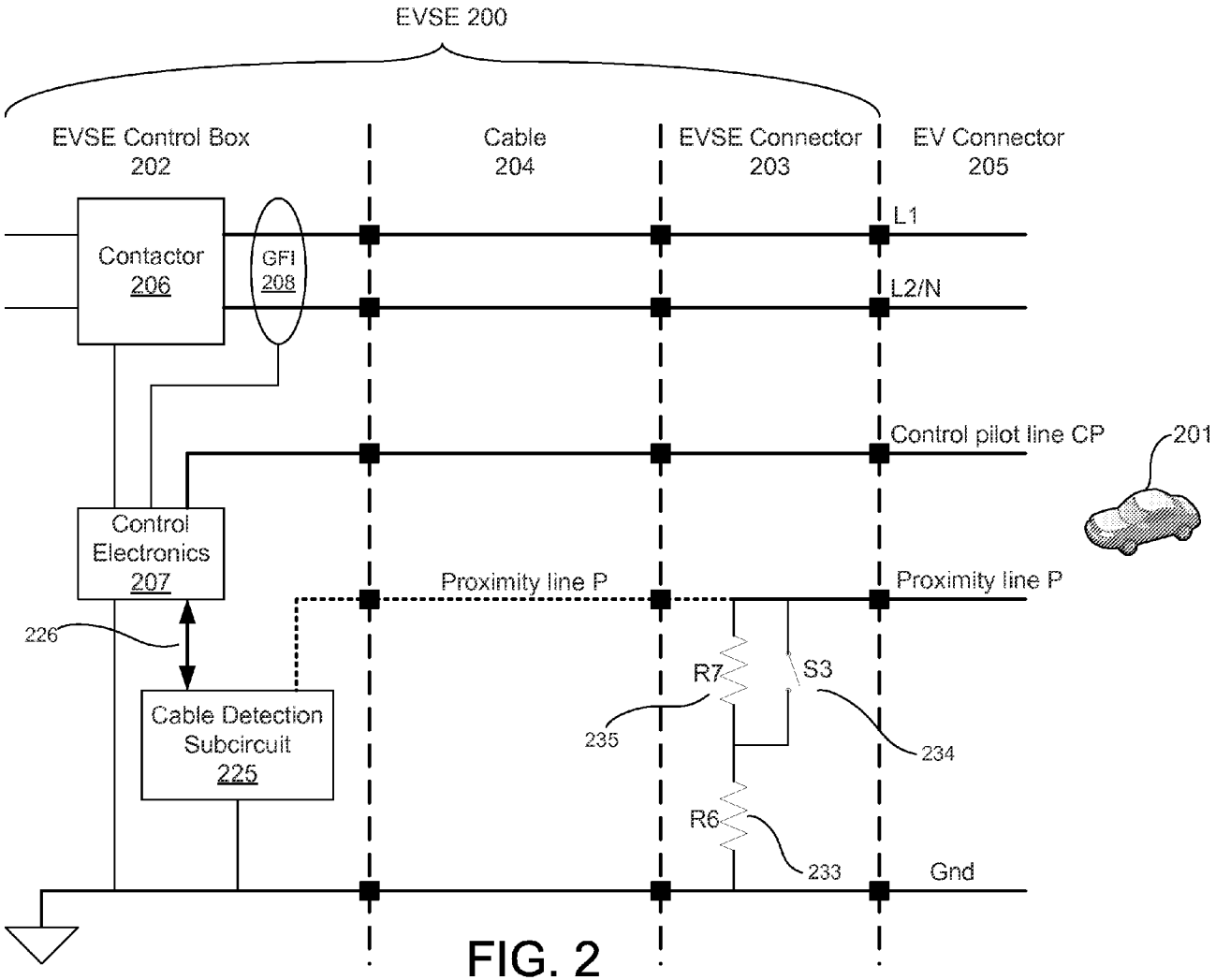
FIG. 2 is a diagram illustrating another example configuration of electric vehicle supply equipment according to an aspect of the present disclosure.

FIG. 2 illustrates another example embodiment of EVSE 200. As shown in FIG. 2, the EVSE 200 may include an EVSE control box 202, an EVSE connector 203, and a cable 204. In FIG. 2, the EVSE 200 is electrically connected to an electric vehicle connector 205 of an electric vehicle 201. Further, the EVSE 200 includes five conductors: first power line L1, second power line L2/N, control pilot line CP, proximity line P, and ground line Gnd. Each of these conductors extends out of the EVSE control box 202 through the cable 204 to the EVSE connector 203. At the EVSE connector 203, an end of each of the conductors is exposed. That is, the EVSE connector 203 includes five contact points for allowing access to the five conductors, respectively.

Meanwhile, the electric vehicle connector 205 also includes five contact points configured to respectively connect to the five contact points of the EVSE connector 203. Through the five contact points of its electric vehicle connector 205, the electric vehicle 201 may electrically connect to each of the five conductors of the EVSE 200, as shown in FIG. 2.

FIG. 2 also shows that the EVSE control box 202 may include a contactor (or relay) 206, control electronics 207, a ground fault interrupter (GFI) 208, and a cable detection subcircuit 225. As shown in FIG. 2, the cable detection subcircuit 225 may be connected to the control electronics 207, the ground line Gnd, and a cable detection line. Herein, the cable detection line refers to any line that runs through the cable 204 and is coupled to the cable detection subcircuit 225 for the purpose of forming a closed circuit loop. In FIG. 2, the cable detection line is referred to as the proximity line P because it carries the same signal that would be supplied to the electric vehicle 201 via the proximity line P.

Notably, according to industry standards (see e.g., SAE J1772), a portion of the proximity line P is optional (illustrated by the dotted line in FIG. 2). Specifically, it is not necessary to include the proximity line P in the cable 204 or EVSE control box 202 to comply with industry standards, such as SAE J1772. To comply with SAE J1772, the proximity line P only needs to extend into the EVSE connector 203 where it is connected to a proximity circuit (the required portion is shown by the solid segment of the proximity line P in FIG. 2). As mentioned above with regards to FIG. 1, the proximity circuit is included in the EVSE connector 203 for the purpose of notifying the electric vehicle 201 that the EVSE connector 203 is connected to the electric vehicle connector 205. In FIG. 2, the proximity circuit of the EVSE connector 203 includes resistors (R6 and R7) 233 and 235 and switch (S3) 234 (corresponding to like reference elements in FIG. 1). Although FIGS. 1 and 2 show similar configurations for the proximity circuit, it should be understood that other configurations of the proximity circuit may be implemented.

In the example embodiment of FIG. 2, the optional portion of the proximity line P is included. That is, the proximity line P extends through the cable 204 into the EVSE control box 202 where it is electrically connected to the cable detection subcircuit 225. Accordingly, the cable detection subcircuit 225 may be connected to the proximity circuit in the EVSE connector 203 at the other end of the cable 204. Further, because the cable detection subcircuit 225 and the proximity circuit are both connected to the ground line Gnd, a closed circuit loop may be formed. Specifically, the closed circuit loop would include the cable detection subcircuit 225, the proximity line P, the proximity circuit, and the ground line Gnd.

In an embodiment, by detecting whether an impedance along the closed circuit loop matches an expected impedance of the proximity circuit, i.e., resistors (R6 and R7) 233 and 235 (and taking into account any line resistance if necessary), the cable detection subcircuit 225 may detect whether the cable 204, or a portion thereof, has been removed. The cable detection subcircuit 225 initiates impedance matching by injecting a current into the proximity line P. Specifically, the cable detection subcircuit 225 may include a current source coupled between the ground line Gnd and the proximity line P to close the circuit and allow the current to travel through the closed circuit. If the detected impedance matches the expected impedance, then the cable detection subcircuit 225 may determine that the cable 204 has not been removed (i.e., that the cable 204 remains entirely intact). For example, if the cable 204 has not been removed, then the current would travel around the closed circuit loop and the cable detection subcircuit 225 would detect that the impedance matches the expected impedance. However, if the detected impedance does not match the expected impedance, the cable detection subcircuit 225 may determine that the cable 204 has been removed. For example, if the cable 204 has been removed, then a closed circuit loop should not be formed, and, even if a closed circuit loop were to form, the impedance should not match the expected impedance. In particular, when the cable 204 has been removed, the detected impedance should be infinite (in theory) due to the open circuit formed as a result of the removed cable 204. Thus, if the cable 204 was stolen, the cable detection subcircuit 225 may detect such an occurrence. It should be understood that the expected impedance of the proximity circuit may be determined in advance based on the known resistance of the proximity circuit (e.g., resistors R6 and R7) and/or the cable 204 itself. Of course, whether a match is detected may allow for some tolerance (i.e., a match may occur if the impedance is within some range of the expected impedance).

Although one aspect of the disclosure is to detect whether a cable 204 is stolen, the cable detection subcircuit 225 might not distinguish whether the cable 204 was intentionally or unintentionally removed or whether the removal was authorized or unauthorized. Therefore, the cable detection subcircuit 225 may detect that the cable 204 was stolen even though the cable 204 was removed for repair or replacement. Also, the cable detection subcircuit 225 may detect that the cable 204 was stolen even when the reason that the closed circuit loop is not formed is because a conductor in the cable 204 (e.g., the proximity line P or ground line Gnd) is damaged. However, whatever the actual reason for the cable detection subcircuit 225 detecting that the cable 204 has been removed, the cable detection subcircuit 225 may assume that the cable 204 is stolen in order to be overly protective by design or because theft may be the most likely reason for the cable 204 missing.

Further, the cable detection subcircuit 225 may be configured to generate and/or transmit an output signal in response to the results of detecting whether the cable 204 has been removed or not. As shown in FIG. 2, the cable detection subcircuit 225 may transmit a signal on line 226 indicating whether the cable 204 has been removed or not to the control electronics 207. This output signal may take various forms. For example, the output signal may be a digital signal that has a logic high voltage when the cable detection subcircuit 225 detects that the cable 204 has been removed from the EVSE 200 and has a logic low voltage when the cable detection subcircuit 225 detects that the cable 204 remains connected to the EVSE 200.

Additionally, the cable detection subcircuit 225 may be configured to receive a signal from the control electronics 207. Specifically, the control electronics 207 may transmit a signal to the cable detection subcircuit 225 to control when the cable detection subcircuit 225 performs cable detection. The control electronics 207 may include a monitoring circuit (not shown in FIG. 2) to detect when the EVSE 200 is connected to the electric vehicle 201 and/or charging the electric vehicle 201, and may send a signal to the cable detection subcircuit 225 based on this detection. In some embodiments, the control electronics 207 may only permit the cable detection subcircuit 225 to perform cable detection when the EVSE 200 is not connected to an electric vehicle 201 or charging the electric vehicle 201. The EVSE 200 may determine that the cable 204 remains connected to the EVSE 200 when the control electronics 207 detects a connection to the electric vehicle 201, and in this case, the EVSE 200 may prevent the cable detection subcircuit 225 from performing cable detection. In other embodiments, the cable detection subcircuit 225 may perform cable detection upon a user command or according to an algorithm. For example, the cable detection subcircuit 225 may perform cable detection periodically (e.g., every ten minutes, every hour, etc.), after a predetermined period of inactivity, or at a predetermined time (e.g., at 1:00 pm, at 1:00 am, etc.). In one or more arrangements, the predetermined time may be a time when the EVSE 200 is not available for use, such as late at night when a charging facility/station is closed.

Although FIG. 2 shows the cable detection subcircuit 225 communicating with the control electronics 207, the cable detection subcircuit 225 may communicate with other devices as well. In particular, the output signal may be transmitted to a computing device or output device for triggering a response to detecting that the cable 204 has been removed. For example, the output signal may be transmitted to an output device which sounds an alarm indicating that the cable 204 has been removed. Accordingly, where the cable 204 has been stolen, the alarm may alert others, such as an operator or owner of the EVSE 200, users of the EVSE 200, and bystanders, of the theft. Therefore, the identity of the person who stole the cable 204 may be determined. Also, the alarm may assist in deterring people from attempting to steal the cable 204.

Additionally, or alternatively, the output signal may be transmitted to an output device (e.g., a phone, pager, laptop, computer, etc.) accessible by an operator or owner of the EVSE 200 thereby notifying the operator or owner that the cable 204 has been removed. The operator or owner may then take action accordingly. For example, the owner or operator may go to the area of the EVSE 200 from which the cable 204 was removed to determine the cause. Where the cable 204 was removed because it was stolen, the owner or operator may be able to identify the person who stole it or a license plate of a car used by the thief. Alternatively, the owner or operator may choose to dispatch a repairman to fix the EVSE 200. Further, the output signal may be transmitted to a security company, which may alert authorities (e.g., police) or may dispatch a private security team/investigator.

In some embodiments, the output signal may be transmitted to an output device, such as a camera, for automatically capturing information in response to detecting the removal of the cable 204. Specifically, the output signal may trigger a camera to capture an image of the EVSE 200 or its surrounding area soon after the cable detection subcircuit 225 determines that the cable 204 has been removed.

Also, the output signal may be transmitted to a computing device for determining a time (or approximate time) at which the cable 204 was removed. The computing device may then determine whether the time falls within a set window of time during which removal of the cable may or may not be permitted. For example, an owner or operator of the EVSE 200 may be aware of maintenance to be performed on the cable 204, and thus, may set a window of time during which the cable 204 may be removed. In contrast, for example, a window of time may be set to cover a time at night when removal of the cable 204 is more likely to be due to theft. And thus, if the removal of the cable 204 occurs at night, then the computing device may infer that the removal was not permitted, and may trigger a response accordingly.

Figure 3:
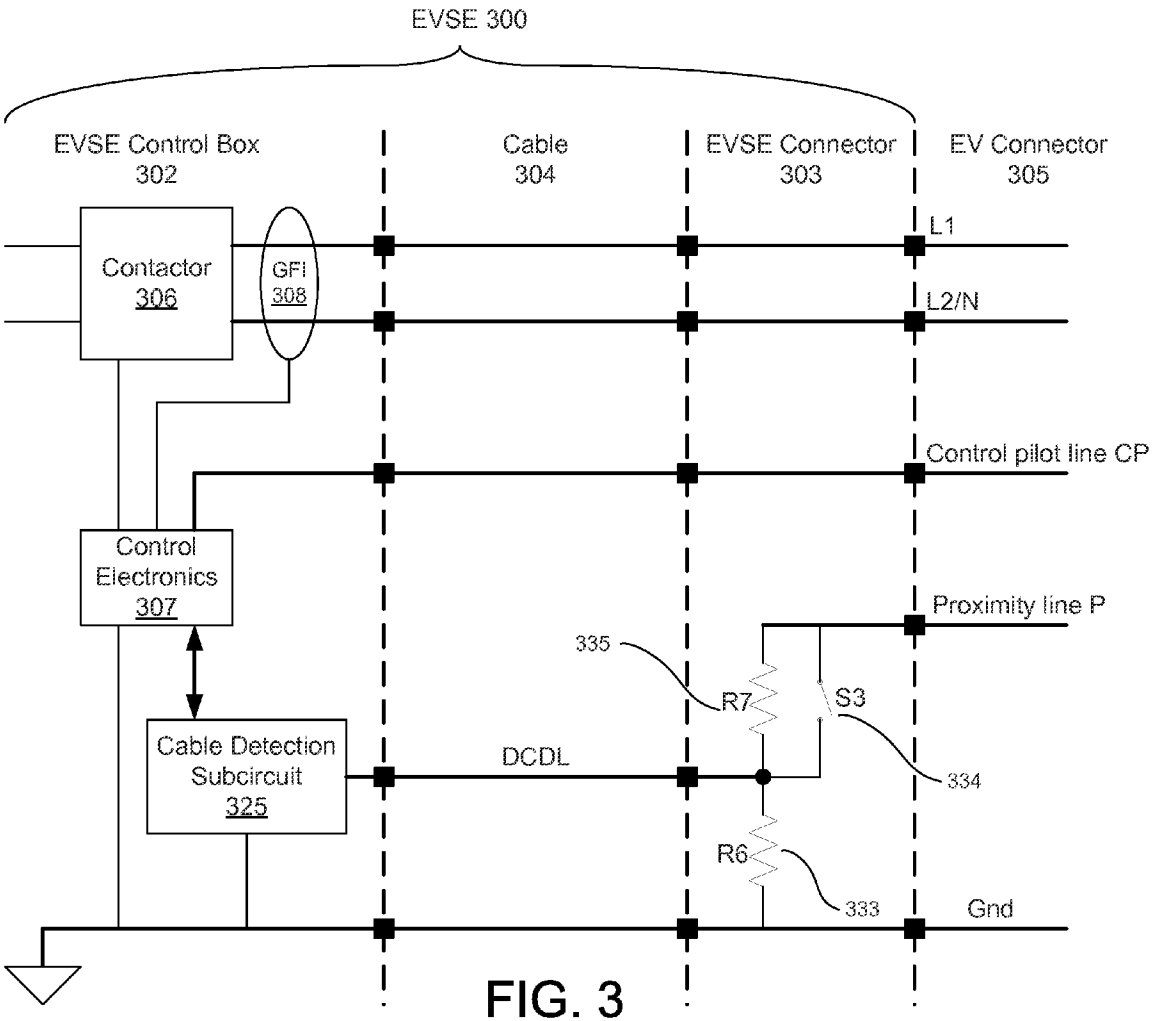
FIG. 3 is a diagram illustrating yet another example configuration of electric vehicle supply equipment according to an aspect of the present disclosure.

FIG. 3 illustrates yet another example embodiment of an EVSE 300. The EVSE 300 is similar in most regards to the EVSE 200 of FIG. 2. An EVSE control box 302, EVSE connector 303, cable 304, and electric vehicle connector 305 of FIG. 3 may be similarly configured to the EVSE control box 202, the EVSE connector 203, the cable 204, and electric vehicle connector 205 of FIG. 2, respectively. However, the EVSE 300 illustrates another manner in which a cable detection subcircuit 325 (which may be similar to the cable detection subcircuit 225 of FIG. 2) may be connected to the proximity circuit of the EVSE 303. In FIG. 3, the cable detection line that runs through the cable 204 and is coupled to the cable detection subcircuit 325 for the purpose of forming a closed circuit loop is referred to as a dedicated cable detection line DCDL because this line carries a different signal than the proximity line P.

As shown in FIG. 3, via the dedicated cable detection line DCDL, the cable detection subcircuit 325 may be coupled to a different node within the proximity circuit. Specifically, FIG. 3 illustrates the cable detection subcircuit 325 connected to a node between the resistor (R6) 333 and the switch (S3) 334 (or resistor (R7) 335). Accordingly, the signal received by the cable detection subcircuit 325 may be different than the signal on the proximity line P. However, the cable detection subcircuit 325 may still detect whether there is a closed circuit loop, and thus, may determine whether the cable 305 has been removed.

Figure 4:
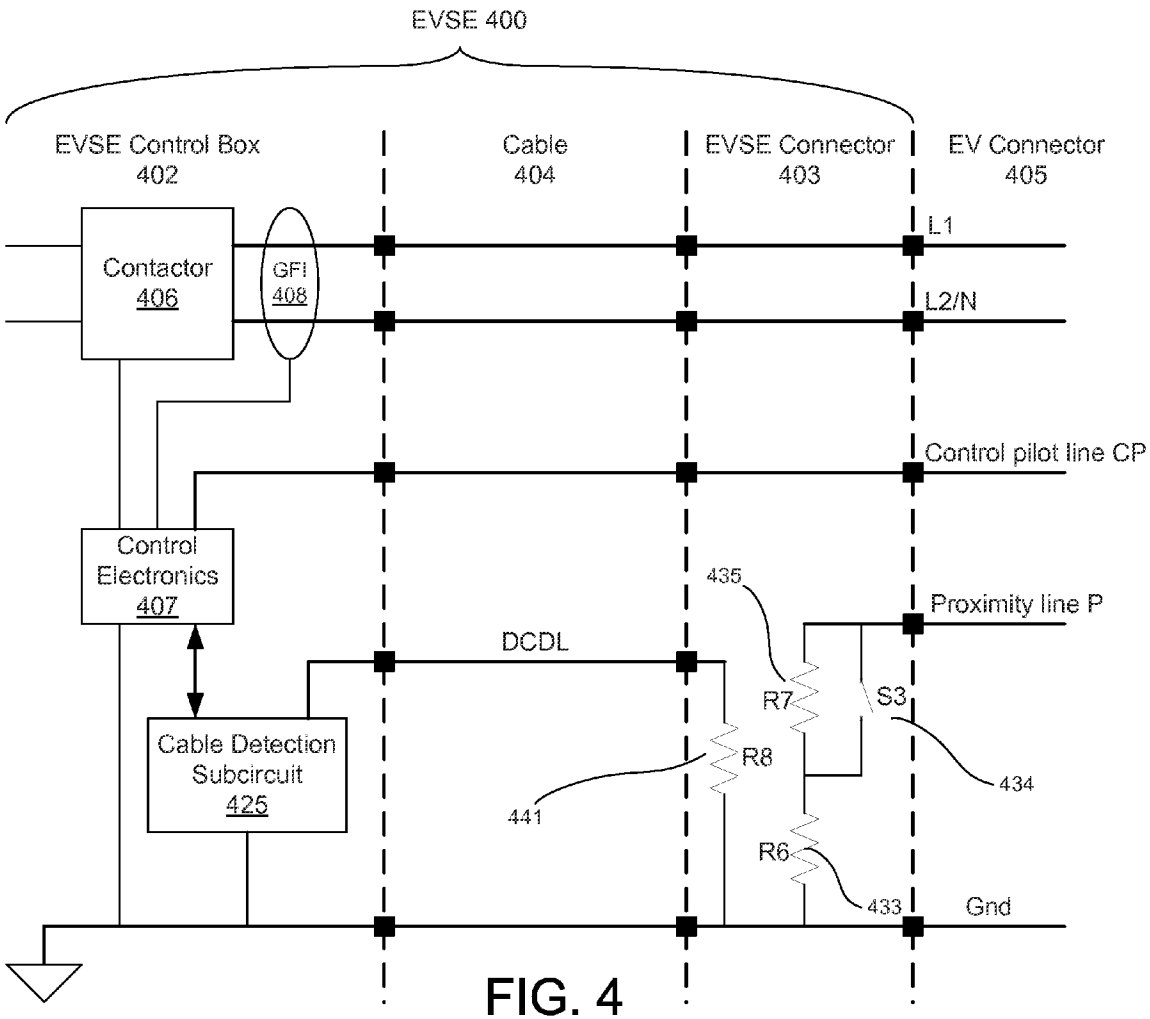
FIG. 4 is a diagram illustrating still another example configuration of electric vehicle supply equipment according to an aspect of the present disclosure.

FIG. 4 illustrates still another example embodiment of an EVSE 400. The EVSE 400 is similar in most regards to the EVSE 200 of FIG. 2. An EVSE control box 402, EVSE connector 403, cable 404, and electric vehicle connector 405 of FIG. 4 may be similarly configured to the EVSE control box 202, the EVSE connector 203, the cable 204, and electric vehicle connector 205 of FIG. 2, respectively. However, the EVSE 400 illustrates that a cable detection subcircuit 425 (which may be similar to the cable detection subcircuit 225 of FIG. 2) may be connected to another circuit, i.e., other than the proximity circuit (having resistor (R6) 433, resistor (R7) 435, switch (S3) 434), within the EVSE connector 403.

As shown in FIG. 4, the cable detection subcircuit 425 may be coupled to a resistor (R8) 441 located in series between a dedicated cable detection line DCDL and the ground line Gnd. Notably, the dedicated cable detection line DCDL may be solely for use by the cable detection subcircuit 425. The dedicated cable detection line DCDL may extend through the cable 404 from the EVSE control box 402 to the resistor (R8) 441 in the EVSE connector 403. FIG. 4 further illustrates that the dedicated cable detection line DCDL may be solely connected to the resistor (R8) 441. Notably, the dedicated cable detection line DCDL might not be exposed by the EVSE connector 403, and might not be connected to the electric vehicle connector 405.

Although FIG. 4 illustrates that the resistor (R8) 441 is the only component for connecting the dedicated cable detection line DCDL to the ground line Gnd, it should be understood that another circuit may be used. Further, while the resistor (R8) 441 is illustrated as being positioned within the EVSE connector 403, in other embodiments the resistor (R8) 441 (or another circuit) may be positioned within the cable 404. By positioning the resistor (R8) 441 in the EVSE connector 403, the cable detection subcircuit 425 may be able to detect whether any portion of the cable 404 is removed. However, in some embodiments, it may be desirable (e.g., to reduce costs associated with running another conductor along the entire length of the cable) to position the resistor within the cable 404. If the resistor (R8) 441 is positioned closer to the end of the cable 404 that is connected to the EVSE connector 403, the cable detection subcircuit 425 may be able to detect whether most of the cable remains or not. In contrast, if the resistor R8 is positioned closer to the end of the cable 404 that is connected to the EVSE control box 402, the cable detection subcircuit 425 may not detect that a majority of the cable 404 has been removed; however, less conductive material could be used for the dedicated cable detection line DCDL. In some embodiments, it may be anticipated that a person attempting to steal the cable 404 would cut the cable 404 at a point close to the EVSE control box 402, and thus, in such embodiments, it may be acceptable to position the resistor (R8) 441 (or a similar circuit) within the cable 404 at a position closer to the EVSE control box 402.

Figure 5:
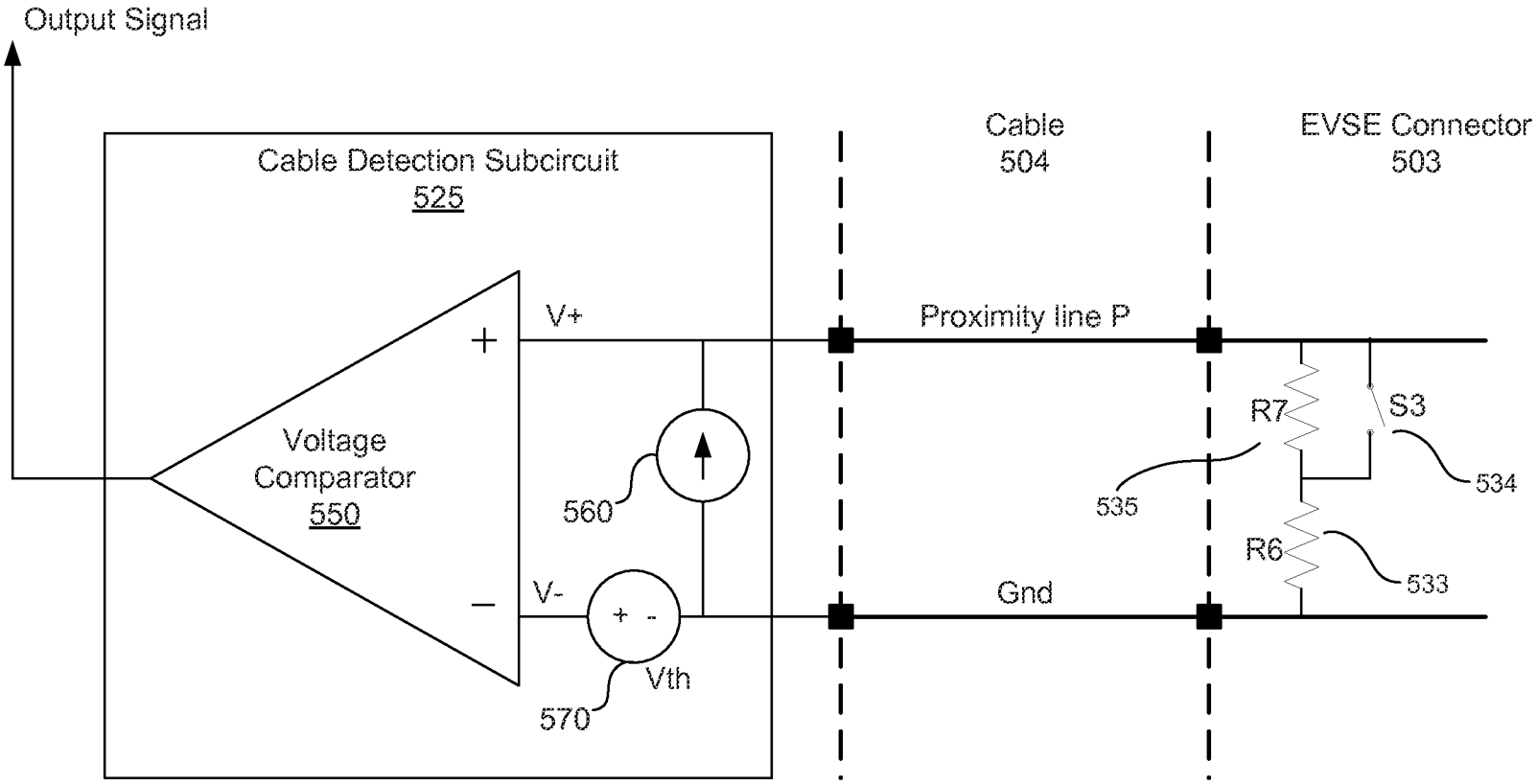
FIG. 5 is a circuit diagram illustrating an example configuration of a cable detection subcircuit according to an aspect of the present disclosure.

FIG. 5 illustrates an example configuration of a cable detection subcircuit 525. The cable detection subcircuit 525 may be implemented as the cable detection subcircuit 225 of FIG. 2, the cable detection subcircuit 325 of FIG. 3, and the cable detection subcircuit 425 of FIG. 4; however, FIG. 5 shows the cable detection subcircuit 525 connected to the proximity line P as in FIG. 2.

As shown in FIG. 5, the cable detection subcircuit 525 may include a voltage comparator 550, a current source 560, and a voltage source 570. The voltage comparator 550 may have two inputs: a non-inverting input V+ and an inverting input V−. When the voltage at the non-inverting input V+ exceeds the voltage at the inverting input V−, the voltage comparator 550 outputs a logic high voltage. In the cable detection subcircuit 525, the voltage source 570 supplies a threshold voltage Vth to the inverting input V−, and thus, the comparator 550 only outputs a logic high voltage when the non-inverting input V+ exceeds the threshold voltage Vth.

The current source 560 injects a current into the circuit loop, including the proximity line P, the proximity circuit (e.g., resistors (R6 and R7) 533 and 535 and switch (S3) 534), and the ground line Gnd. When the cable 504 has not been removed, the current may travel around the loop through the proximity line P, the proximity circuit, and the ground line Gnd. At this time, the voltage at the non-inverting input V+ will be lower than the voltage at the inverting input V− because the current may flow through the proximity circuit. And, since the voltage at the non-inverting input V+ is lower than the voltage at the inverting input V−, the voltage comparator 550 does not output a logic high voltage. In contrast, when the cable 504 has been removed, the current cannot travel through the proximity line P, the proximity circuit, and the ground line Gnd as that circuit loop would be open. In that case, the circuit loop is open, and the voltage at the non-inverting input V+ will become greater than the voltage at the inverting input V− because the current supplied by the current source 560 travels to the non-inverting input V+. Further, the cable detection subcircuit 525 is configured so that the current source 560 can deliver a voltage to the non-inverting input V+ that exceeds the threshold voltage Vth supplied to the inverting input V−. Thus, the voltage comparator 550 will generate a high output indicating that the cable 504 has been removed.

Figure 6:
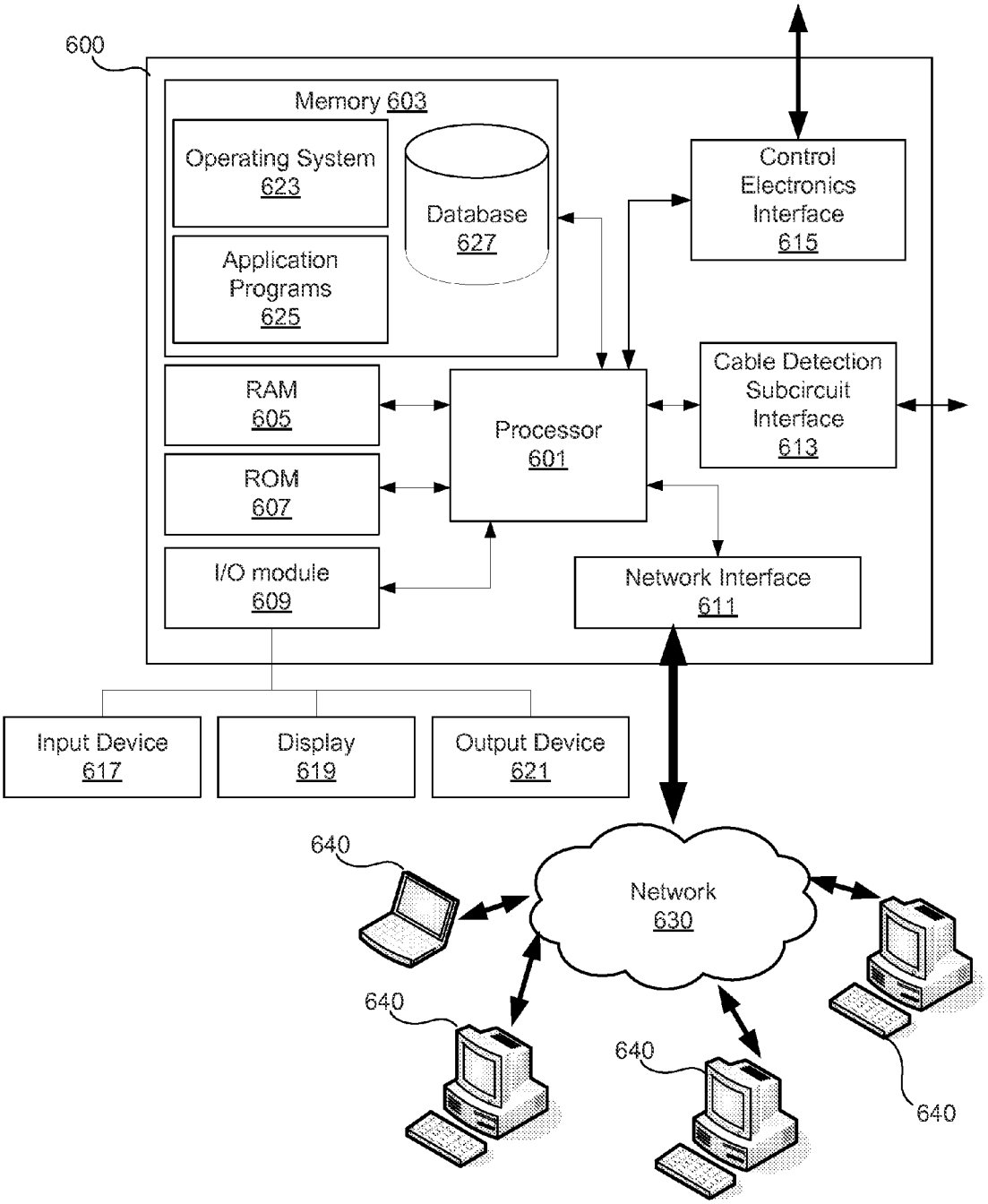
FIG. 6 is a block diagram of an example computing device that may be used according to an illustrative embodiment of the present disclosure.

FIG. 6 illustrates a block diagram of an example computing device 600 that may be used according to an illustrative embodiment of the present disclosure. In one or more embodiments of the present disclosure the computing device 600 may be incorporated into the EVSE 100, 200, 300, 400. Or, the computing device 600 may be incorporated into a system including the EVSE 100, 200, 300, 400, but may be external to the EVSE 100, 200, 300, 400. That is, the EVSE 100, 200, 300, 400 may communicate, via a network, with the computing device 600 located remotely.

As shown in FIG. 6, the computing device 600 may have a processor 601 that may be capable of controlling operations of the computing device 600 and its associated components, including memory 603, RAM 605, ROM 607, an input/output (I/O) module 609, a network interface 611, a cable detection subcircuit interface 613, and a control electronics interface 615.

The I/O module 609 may be configured to be connected to an input device 617 (e.g., keypad, microphone, etc.) and a display 619 (e.g., a monitor, touchscreen, etc.). The display 619 and input device 617 are shown as separate elements from the computing device 600; however, they may be within the same structure in some embodiments. Additionally, the I/O module 609 may be configured to connect to an output device 621 (e.g., a light, an alarm, a mechanical sign, etc.), which may be configured to indicate a status of the EVSE 200, and in particular, a status of the cable 204 of the EVSE 200 in response to results provided by the cable detection subcircuit 225. The processor 601, through the I/O module 609, may control the output device 621 to indicate that the cable 204 was removed. For example, the processor 601 may determine that the removal of the cable 204 was unauthorized, and thus, may send a signal to the output device 621 to sound an alarm, flash a light, notify others (e.g., an owner, operator, police, security personnel, etc.), capture an image, etc.

The memory 603 may be any computer readable medium for storing computer-executable instructions (e.g., software). The instructions stored within memory 603 may enable the computing device 600 to perform various functions. For example, memory 603 may store computer-executable instructions for processing an output signal received from the cable detection circuit 225 and controlling responses accordingly. Also, memory 603 may store criteria, such as time windows, for making determinations disclosed herein. Moreover, memory 603 may store IP addresses of other computing devices to communicate with in case removal of the cable 204 is detected. Further, memory 603 may store software used by the computing device 600, such as an operating system 623 and/or application programs (e.g., a control application) 625, and may include an associated database 627.

The network interface 611 allows the computing device 600 to connect to and communicate with other computing devices 640 via a network 630 (e.g., the Internet) as known in the art. The network interface 611 may connect to the network 630 via known communications lines or wirelessly using a cellular backhaul or wireless standard (e.g., IEEE 802.11). Further, the network interface 611 may use various protocols, including Transfer Control Protocol/Internet Protocol (TCP/IP), User Datagram Protocol/Internet Protocol (UDP/IP), Ethernet, File Transfer Protocol (FTP), Hypertext Transfer Protocol (HTTP), PROFIBUS, Modbus TCP, DeviceNet, Common Industrial Protocol (CIP) etc., to communicate with other computing devices 640.

The cable detection subcircuit interface 613 may be configured to receive inputs from the cable detection subcircuit 225. Via the cable detection subcircuit interface 613, the computing device 600 may input a signal indicating whether the cable 204 has been removed or not. The cable detection subcircuit interface 613 may then provide this signal to the processor 601 to, for example, determine if the cable 204 was removed because of theft and/or to output a signal alerting others. The cable detection subcircuit interface 613 may also be used to transmit a signal to the cable detection subcircuit 225 for controlling when the cable detection subcircuit 225 performs detection. For example, the computing device 600 may determine when the cable detection subcircuit 225 should inject a current into the proximity line P, and therefore, a signal controlling the cable detection subcircuit 225 to do so may be outputted via the cable detection subcircuit interface 613.

Additionally, the control electronics interface 615 may be configured to communicate with the control electronics 207. Notably, the control electronics interface 615 may allow for bidirectional communication. Via the control electronics interface 615, the computing device 600 may output signals to, e.g., direct the control electronics 207 to open/close the contactor 206. Meanwhile, the control electronics interface 615 may also allow the computing device 600 to receive signals indicating whether, for example, the contactor 206 is open or closed. In some embodiments, the processor 601 may communicate, via the control electronics interface 615, with the control electronics 207 to ensure that the contactor 206 is open before directing the cable detection subcircuit 225, via the cable detection subcircuit interface 613, to inject a current into the cable 204.

The computing device 600 may also be a mobile device so that it may be removably connected to the EVSE 600. Thus, the computing device 600 may also include various other components, such as a battery, speaker, and antennas (not shown). Further, where the computing device 600 is incorporated into the EVSE 100, 200, 300, 400, the computing device 600 may be configured so that it can be removed. In this manner, if the computing device 600 fails, it may be easily replaced without having to replace the entire EVSE 100, 200, 300, 400.

Aspects of the disclosure have been described in terms of illustrative embodiments thereof. Numerous other embodiments, modifications, and variations within the scope and spirit of the appended claims will occur to persons of ordinary skill in the art from a review of this disclosure. For example, one of ordinary skill in the art will appreciate that the values of voltages used in the cable detection subcircuit 225 may change in accordance with aspects of the disclosure.

What is claimed is:

1. Electric vehicle supply equipment, comprising:

a contactor;

a control box housing the contactor;

a cable having a first end coupled to the control box and a second end coupled to a connector configured to connect to an electric vehicle inlet for charging an electric vehicle; and a cable detection subcircuit housed within the control box and configured to detect a status of the cable when the cable is not connected to an electric vehicle;

wherein the cable comprises:

a plurality of power lines configured to supply electric power via the connector to an electric vehicle;

a ground line configured to connect a ground terminal of the electric vehicle supply equipment via the connector to a ground terminal of an electric vehicle;

a cable detection line having a first end that is electrically connected to the cable detection subcircuit and extends at least partially through the cable to a node within the cable or within the connector; and a pilot line configured to carry a signal to an electric vehicle, the pilot line extending from the first end of the cable to the second end of the cable, wherein the cable detection subcircuit comprises:

a voltage comparator configured to compare a first voltage at a first voltage terminal with a second voltage at a second voltage terminal;

a current source coupled between the first voltage terminal and a ground node, the current source configured to supply a current to the first voltage terminal; and a voltage source coupled between the second voltage terminal and the ground node, the voltage source configured to supply a threshold voltage to the second voltage terminal, wherein the first voltage terminal is electrically connected to the cable detection line at the first end of the cable detection line, wherein the ground node is electrically connected to the ground line, and wherein the cable detection subcircuit, the cable detection line, at least one circuit element between the node and the ground line, and the ground line are included in a closed circuit loop when the cable is not connected to an electric vehicle.

2. The electric vehicle supply equipment of claim 1, wherein the cable detection subcircuit injects a current into the closed circuit loop, and wherein the cable detection subcircuit detects whether an impedance of a circuit matches an expected impedance.

3. The electric vehicle supply equipment of claim 2, wherein the circuit is a proximity circuit included within the connector.

4. The electric vehicle supply equipment of claim 3, wherein the proximity circuit includes a resistor coupled in series with a switch, the switch configured to close when the connector is connected to an electric vehicle.

5. The electric vehicle supply equipment of claim 2, wherein the circuit is a circuit within the connector.

6. The electric vehicle supply equipment of claim 1, wherein a second end of the cable detection line is electrically connected to a proximity line configured to carry a proximity signal to an electric vehicle indicating that the connector is coupled to the electric vehicle, and wherein the connector comprises a proximity circuit configured to generate the proximity signal.

7. The electric vehicle supply equipment of claim 1, further comprising:

the connector coupled to the second end of the cable and configured to electrically connect the plurality of power lines to an electric vehicle, wherein the connector comprises a proximity circuit configured to generate a proximity signal that is to be delivered to an electric vehicle when the connector is coupled to the electric vehicle, and wherein the node is a node of the proximity circuit.

8. The electric vehicle supply equipment of claim 1, further comprising:

the connector coupled to the second end of the cable and configured to electrically connect the plurality of power lines to an electric vehicle, wherein the connector includes a circuit that couples the node to the ground line.

9. The electric vehicle supply equipment of claim 1, wherein a second end of the cable detection line is coupled to the ground line via the at least one circuit element at a position within the cable.

10. The electric vehicle supply equipment of claim 9, further comprising:

the connector coupled to the second end of the cable and configured to electrically connect the plurality of power lines to an electric vehicle, wherein the position within the cable is closer to the first end of the cable than to the second end of the cable.

11. The electric vehicle supply equipment of claim 1, wherein the control box houses circuitry configured to generate the signal on the pilot line and to determine a state of an electric vehicle by monitoring the pilot line.

12. The electric vehicle supply equipment of claim 1, further comprising:

a computing device comprising:

an interface configured to receive an output signal of the cable detection subcircuit;

an output module configured to output a second output signal to an output device;

a processor; and memory storing computer-executable instructions that, when executed by the processor, cause the computing device to:

determine whether the cable has been disconnected from the electric vehicle supply equipment based on the output signal received by the interface; and generate the second output signal in a case that the processor determines that the cable has been disconnected from the electric vehicle supply equipment.

13. The electric vehicle supply equipment of claim 1, further comprising:

an output device configured to receive an output signal from the cable detection subcircuit, and, in response to receiving the output signal, to perform at least one of:

transmitting a signal to a specified computing device;

sounding an alarm;

turning on a light; or capturing an image.

14. The electric vehicle supply equipment of claim 1, wherein detecting the status of the cable comprises detecting whether the cable is intact and coupled to the control box.

15. Electric vehicle supply equipment, comprising:

a control box comprising a cable detection subcircuit and a contactor that controls power lines configured to supply power to an electric vehicle;

a cable having a first end coupled to the control box, the cable comprising:

a ground line configured to connect a ground terminal of the electric vehicle supply equipment to a ground terminal of an electric vehicle; and a cable detection line extending from the cable detection subcircuit to a node; and a connector coupled to a second end of the cable and configured to connect power lines and the ground line to an electric vehicle inlet for charging an electric vehicle, the connector comprising a circuit configured to electrically connect the node to the ground line, wherein the cable detection subcircuit comprises a first input that is electrically connected to the cable detection line and a second input that is electrically connected to the ground line, wherein the cable detection subcircuit is part of a closed circuit loop when the cable is not connected to an electric vehicle, and wherein the cable detection subcircuit is configured to detect whether a portion of the cable has been electrically disconnected from the electric vehicle supply equipment, wherein the cable detection subcircuit, comprises:

a voltage comparator configured to compare a first voltage at a first voltage terminal with a second voltage at a second voltage terminal;

a current source coupled between the first voltage terminal and a ground node, the current source configured to supply a current to the first voltage terminal; and a voltage source coupled between the second voltage terminal and the ground node, the voltage source configured to supply a threshold voltage to the second voltage terminal, wherein the first voltage terminal is electrically connected to the first input that is electrically connected to the cable detection line, and wherein the ground node is electrically connected to the second input that is electrically connected to the ground line.

16. The electric vehicle supply equipment of claim 15, wherein the control box further houses control electronics configured to control the contactor, wherein the voltage comparator transmits an output signal to the control electronics, the output signal indicating whether the cable is coupled to the control box, and wherein the control electronics are configured to open the contactor in response to receiving the output signal having a certain voltage.

17. The electric vehicle supply equipment of claim 15, further comprising:

a computing device comprising:

a processor; and memory storing computer-executable instructions that, when executed by the processor, cause the computing device to determine whether at least a part of the cable has been electrically disconnected from the electric vehicle supply equipment, wherein the voltage comparator transmits an output signal to the computing device, the output signal indicating a result of comparing the first voltage with the second voltage.

18. Electric vehicle supply equipment, comprising:

a control box comprising a contactor that controls power lines configured to supply electric power to an electric vehicle;

a connector configured to connect to an electric vehicle inlet for charging an electric vehicle;

a cable extending from the control box to the connector, the cable comprising:

the power lines;

a ground line configured to connect a ground terminal of the electric vehicle supply equipment via the connector to a ground terminal of an electric vehicle;

a pilot line configured to carry a signal generated by the electric vehicle supply equipment to an electric vehicle; and a cable detection line connected to the ground line via a circuit; and a cable detection subcircuit configured to detect a status of the cable when the cable is not connected to an electric vehicle, wherein the cable detection subcircuit is connected to the cable detection line and the ground line such that the cable detection subcircuit, the cable detection line, the circuit, and the ground line are included in a closed circuit loop when the cable is not connected to an electric vehicle, wherein the cable detection subcircuit, comprises:

a voltage comparator configured to compare a first voltage at a first voltage terminal with a second voltage at a second voltage terminal;

a current source coupled between the first voltage terminal and a ground node, the current source configured to supply a current to the first voltage terminal; and a voltage source coupled between the second voltage terminal and the ground node, the voltage source configured to supply a threshold voltage to the second voltage terminal, wherein the first voltage terminal is electrically connected to the cable detection line, and wherein the ground node is electrically connected to the ground line.

19. The electric vehicle supply equipment of claim 18, wherein the circuit comprises a resistor, and wherein the cable detection subcircuit detects an impedance of the circuit.

20. The electric vehicle supply equipment of claim 1, wherein the first voltage terminal is a non-inverting input of the voltage comparator and the second voltage terminal is an inverting input of the voltage comparator, and wherein the voltage comparator is configured to output a logic high voltage when the first voltage at the non-inverting input exceeds the threshold voltage.

21. The electric vehicle supply equipment of claim 15, wherein the first voltage terminal is a non-inverting input of the voltage comparator and the second voltage terminal is an inverting input of the voltage comparator, and wherein the voltage comparator is configured to output a logic high voltage when the first voltage at the non-inverting input exceeds the threshold voltage.

22. The electric vehicle supply equipment of claim 18, wherein the first voltage terminal is a non-inverting input of the voltage comparator and the second voltage terminal is an inverting input of the voltage comparator, and wherein the voltage comparator is configured to output a logic high voltage when the first voltage at the non-inverting input exceeds the threshold voltage.

* * * * *